US005806626A

United States Patent [19]

Jenkins, Jr.

[11] Patent Number: 5,806,626

[45] Date of Patent: Sep. 15, 1998

[54] MODULAR SAFETY LADDER SYSTEM

[76] Inventor: Joseph Robert Jenkins, Jr., 12203 Becontree Dr., Baton Rouge, La. 70810

[21] Appl. No.: 716,881

[22] Filed: Sep. 20, 1996

[51] Int. Cl.[6] ..... E06C 1/10

[52] U.S. Cl. ..... 182/100; 182/93; 182/189

[58] Field of Search ..... 182/100, 93, 116, 182/189, 3, 8, 9, 187

[56] References Cited

U.S. PATENT DOCUMENTS

| | | | |
|---|---|---|---|
| 2,744,674 | 5/1956 | Smith | 182/189 |
| 3,908,791 | 9/1975 | Kleine | 182/8 |
| 4,592,446 | 6/1986 | White | 182/189 |
| 5,165,499 | 11/1992 | Bell | 182/9 |
| 5,277,273 | 1/1994 | Grimes | 182/187 |
| 5,439,072 | 8/1995 | Jenkins | 182/100 |
| 5,509,499 | 4/1996 | Prejean | 182/93 |

FOREIGN PATENT DOCUMENTS

| | | | |
|---|---|---|---|
| 710340 | 7/1941 | Germany | 182/9 |

OTHER PUBLICATIONS

Loc–On, Catalog, Item No. 3, Mar. 17, 1994.

*Primary Examiner*—Alvin C. Chin-Shue
*Attorney, Agent, or Firm*—Warner J. Delaune

[57] ABSTRACT

A portable safety ladder for climbing trees is provided, comprising a single primary support member having first step; a single secondary support member having a second step, wherein the secondary support member is slidable relative to the primary support member; a locking mechanism operatively disposed between the primary support member and the secondary support member for selectively locking the position of the secondary support member relative to the primary support member; a single flexible strap on the primary support member for suspending the ladder module from the tree, wherein the flexible strap is placed in tension when weight is exerted on the ladder module; first and second stabilizers attached to the primary support member and the secondary support member, respectively, for stabilizing the ladder module against the tree, wherein the first and second stabilizers include surfaces which are caused to forcibly contact the tree when the flexible strap is placed in tension; and a safety loop connected to the flexible strap for allowing a secure attachment between the flexible strap and a coupling device on a climber, wherein the safety loop is constructed in a manner to support the weight of the climber.

18 Claims, 16 Drawing Sheets

MODULAR SAFETY LADDER SYSTEM

BACKGROUND OF THE INVENTION

I. Field of the Invention

The present invention relates generally to ladders, and more particularly to modular ladder systems for climbing trees.

II. Description of Prior Art

In the sport of hunting, especially when the quarry is deer, the use of a tree stand is a very common practice. The tree stand offers many advantages, such as enabling the hunter to view his surroundings from an elevated vantage point, and minimizing the chances of being spotted or smelled by the deer. Therefore, development of tree stand technology to facilitate the achievement of these objectives has been quite progressive, focusing on both portability and adaptability. Despite the advances made in this filed, however, there still remains the problem of actually climbing the tree to set up the tree stand, and a number of prior techniques have been attempted with varying levels of success. Several of these devices are explained below, and each one offers the hunter a unique balance of portability, strength, stability and adaptability to the tree-climbing environment.

The simplest ladder known in the prior art, other than simply using the branches of the tree, is the conventional ladder having two parallel members connected by perpendicular rungs. Whether such a ladder has a unitary construction or is an extension ladder, it is extremely cumbersome for carrying through dense woods and is oftentimes quite heavy. Also, such ladders are necessarily straight and may not be well suited for use with a tree having an irregular shape. Finally, under the adverse conditions presented by most hunting environments, a conventional ladder is typically unstable and dangerous.

To overcome the problem of portability associated with conventional ladders, a number of alternative designs have been attempted. Some devices simply include two or more sections or modules of conventional ladder design which connect end-to-end, and the resulting assembly is tied to the tree to improve stability. While these designs made headway in improving portability, they remain ill-suited for use with trees having an irregular axis or many low branches which interfere with the long straight-line distance that the ladder is meant to span.

Another alternative design also comprises a number of connected modules, where each module has a single vertical member from which several steps are placed perpendicularly thereto. Some models have the steps offset from one another, such as in the case of the "Po-Jo Climbing Pole" manufactured by Amacker International, Inc., in Delhi, La. In other models, the steps are formed in a continuing T-configuration with respect to the vertical member, as seen in the "Sky Ladder" manufactured by Loc-On Company in Greensboro, North Carolina. The assembled ladder is then either tied to the tree with a rope or strap, or attached to the tree by a set of metal tongs. One of the advantages of such devices are that they are more lightweight than those ladders employing parallel vertical members. In those ladders where the steps are arranged in a continuing T-configuration, another purported advantage is that the climber is afforded the ability to place both feet on the same level while climbing, resulting in a more comfortable and stable climb.

Finally, a new generation of tree ladders has been developed in recent years which employs one or more ladder modules which are independently suspendable from a tree.

These ladders address the problem of trees which have: (1) "bell bottoms", or unusually wide trunks, such as cypress and tupelo trees typical in the southern United States; (2) a main vertical axis which is very irregular; and/or (3) many low-level branches which do not allow for a continuous ladder spanning a large distance to the tree stand. Three examples of such ladders are U.S. Pat. No. 5,277,273 issued to Grimes, U.S. Pat. No. 5,509,499 issued to Prejean, and U.S. Pat. No. 5,439,072 issued to Jenkins, the inventor of the present invention.

While each of the foregoing devices are well-suited to climbing trees, they include no means of preventing an accidental fall. Because the climbing height is typically 15–20 feet from the ground, a fall can severely injure or even kill the climber. In fact, many hunters suffer debilitating or fatal injuries each year as a result of falling from tree stands or ladders. Despite these statistics, there are no climbing devices of which the inventor is aware, other than the inventor's own ladder systems, which uniquely combine the advantages of suspendable ladder modules and safety features to help prevent such falls from occurring. In response to the ever-present danger of falling, the present inventor developed a modular safety ladder system having a flexible strap which includes means for connecting the climber directly to the strap, which is disclosed in U.S. Ser. No. 08/707,192 and which disclosure in incorporated herein. The unique combination of features shown in that invention not only prevents injurious falls to the ground, but also avoids placing shock loads on the ladder module itself. Thus, the structural integrity of the ladder module is preserved, requiring only the replacement of a relatively inexpensive strap. While that invention solves much of the problems of falling, the ladder modules cannot be adjusted in length.

What is needed, therefore, is a tree ladder system which provides the convenience of portability, strength, and stability when attached to the tree combined with a safety system which connects the climber to the ladders during the climb, and which can be adjusted in length to accommodate the presence of tree limbs and facilitate transportation of the ladder modules to and from the hunting site. Such safety features should be installable as a retrofit on existing ladders, and they should be quiet and easy to use in the field. Finally, the safety features should be incorporated in a manner that does not place any additional stress on the ladder structure itself in the event of a fall.

SUMMARY OF THE INVENTION

It is therefore an object of this invention to provide a portable tree ladder system which is strong, compact and lightweight.

It is also an object of this invention to provide a portable tree ladder system which is highly adaptable to the particular tree climbing situation by being adjustable in length.

Still another object of this invention is to provide a portable tree ladder system which includes safety features that prevent the climber from falling to the ground and permit the climber to stay within reach of the ladder module to which he is connected.

Another object of this invention is to provide a portable tree ladder system whose safety features avoid placing any additional stress on the ladder module during a fall.

Yet another object of this invention is to provide a portable tree ladder system which is safe and stable when used.

These and other objects and advantages of the present invention will no doubt become apparent to those skilled in the art after having read the following description of the preferred and alternate embodiments, which are contained in and illustrated by the various drawing figures.

Therefore, in a preferred embodiment, a portable ladder module for climbing a tree, comprising a single primary support member having first step; a single secondary support member having a second step, wherein said secondary support member is slidable relative to said primary support member; locking means operatively disposed between said primary support member and said secondary support member for selectively locking the position of said secondary support member relative to said primary support member; single flexible means on said primary support member for suspending said ladder module from said tree, wherein said flexible means is placed in tension when weight is exerted on said ladder module; first and second stabilizing means attached to said primary support member and said secondary support member, respectively, for stabilizing said ladder module against said tree, wherein said first and second stabilizing means includes surfaces which are caused to forcibly contact said tree when said flexible means is placed in said tension; and safety attachment means connected to said flexible means for allowing a secure attachment between said flexible means and a coupling device on a climber, wherein said safety attachment means is constructed in a manner to support the weight of said climber.

DETAILED DESCRIPTION OF THE PREFERRED AND ALTERNATE EMBODIMENTS

Figure 1:
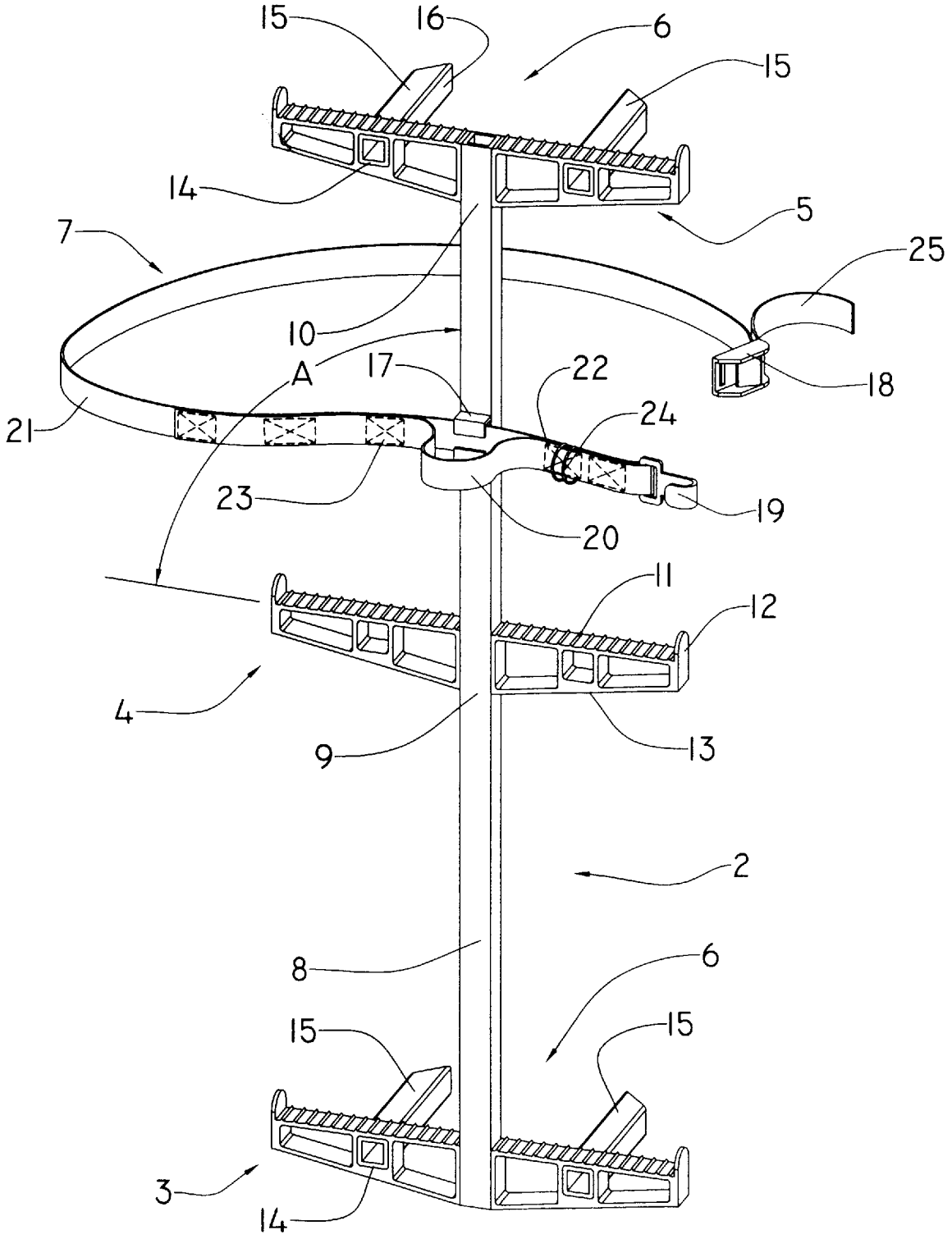
FIG. 1 is a perspective view of a preferred embodiment of the invention, depicting the attached flexible strap with integrated safety loop.

In the drawings many details pertaining to fabrication and maintenance utility well established in the machine construction art and not bearing upon points of novelty are omitted in the interest of descriptive clarity and efficiency. Such details may include threaded connections, lockrings, shear pins, weld lines and the like. Also, the spreading use of electron beam welding eliminates many such features and leaves no visible distinctive lines. Unless otherwise stated herein, all materials of construction are aluminum alloys, although any other materials of equivalent strength may be used, such as steel and a multitude of other composite materials.

Turning now to FIG. 1, a tree ladder module 1 is shown generally comprising a support member 2, a pair of first steps 3, a pair of second steps 4, a pair of top steps 5, stabilizing means 6, and flexible means 7, such as a strap. Support member 2 preferably consists of a straight, rigid section of tubing having a lower end 8, a middle portion 9, and an upper end 10. In keeping with the goal of being lightweight and strong, the cross section of support member 2 has square dimensions of approximately 1"×1" with a wall thickness of about 1/16". The overall length of ladder module 1 is approximately three feet (3'), which makes it quite easy to be carried during a hunting trip, but can be manufactured to any desired length.

First, second, and top steps 3,4,5 are preferably constructed identical to one another so that manufacturing can be automated or otherwise facilitated. For example, in the embodiment of FIG. 1, steps 3,4,5 are shown as cross-sectional portions which have been cut from a single extruded element (not shown). The steps 3,4,5 are then welded to support member 2. Each step includes a slip-resistant upper surface 11, a retaining tab 12, and an underlying support structure 13. The support structure 13 beneath the upper surface 11 includes an opening 14 which receives a portion of stabilizing means 6. In this embodiment, stabilizing means 6 comprises a plurality of stand-off members 15 manufactured from aluminum tubing which are welded into the openings 14 of the lower steps 3 and the top steps 5 as shown in FIG. 1. Stand-off members 15 each include a distal end 16 having edges or points which slightly penetrate the tree after weight has been applied to grip the tree and provide a more stable attachment for climbing. Stand-off members 15 also serve to space the ladder module 1 away from the tree to allow the climber to place the arch of his boot directly over the steps 3,4,5. As an alternative to the edges or points of stand-off members 15, protective covers can optionally be placed over distal ends 16 to protect the tree from damage. Such protective covers may not result in as stable an attachment to the tree, but they would still provide a surface to forcibly contact the tree.

Optionally, the steps 3,4,5 may be manufactured so that the vertical angle A between each upper surface 11 and the support member 2 is less than 90 degrees so that a boot or shoe can be wedged therein during climbing. It can be seen that combination of an inclined, slip-resistant upper surface 11 and retaining tabs 12 serve to minimize the chances of the climber's boot slipping from the steps 3,4,5. While the slip-resistant surface is shown as a plurality of ridges in FIG. 1, this surface can alternatively be added by any one of several methods widely known to those of ordinary skill, such as by an abrasive paint, an adhesive strip having embedded abrasive material, or by forming other types of irregularities into the steps 3,4,5 during manufacturing. Advantageously, top steps 5 permit the climber to place both boots on the same level when standing on top of ladder module 1.

Each ladder module 1 is independently suspendable from the tree by the use of flexible means 7, shown in FIG. 1 as a strap. When weight is exerted onto the ladder module 1, such as when a climber begins to climb, the strap 7 is placed in tension, which causes the edges 16 of the stand-off members 15 to forcibly contact the tree. Thus, the ladder module 1 becomes stabilized and fixed in position by the action of the strap 7 and the stand-off members 15. As shown in FIGS. 14, strap 7 is connected to ladder module 1 by a clip 17 permanently attached to the upper end 10 of support member 2, and is long enough to completely wrap around the tree to be climbed. A self-tightening, quick-release buckle 18 is attached to one end of strap 7, which connects with a corresponding clasp 19, thus ensuring that ladder module 1 will remain attached to the tree during climbing when strap 7 is placed in tension.

Figure 6B:
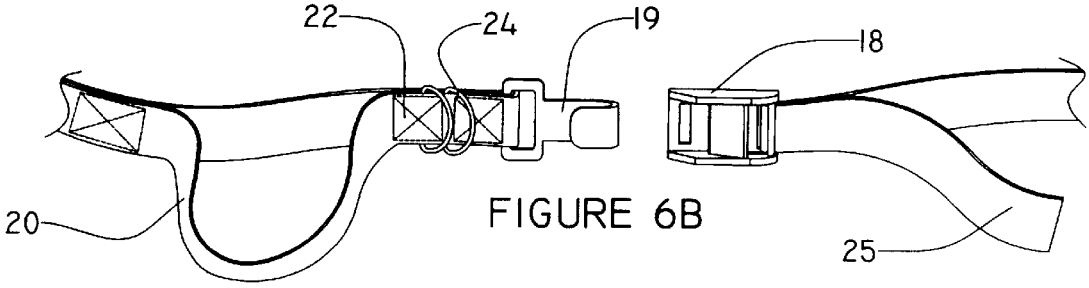
FIGS. 6B–6D are a three-stage depiction of the manner of connecting the flexible strap having the integrated safety loop.
Figure 6C:
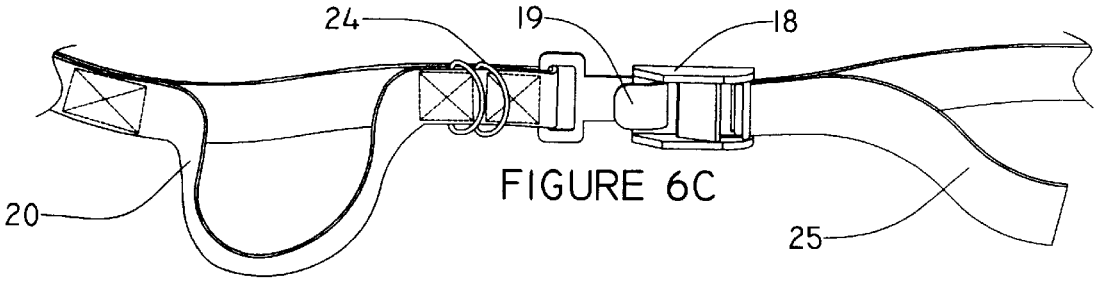
Figure 6D:
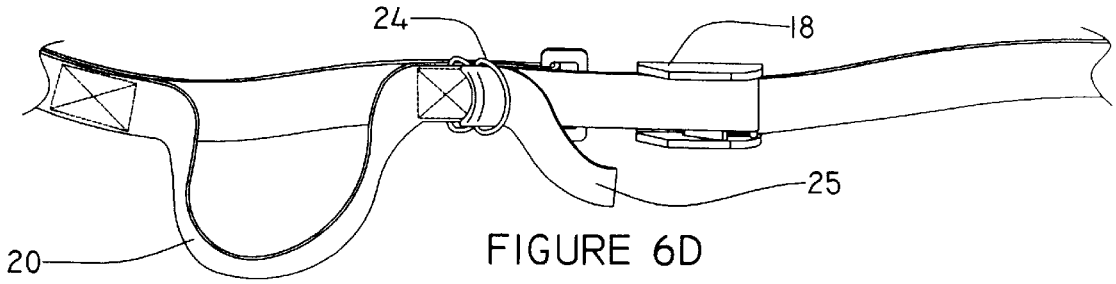
Figure 6A:
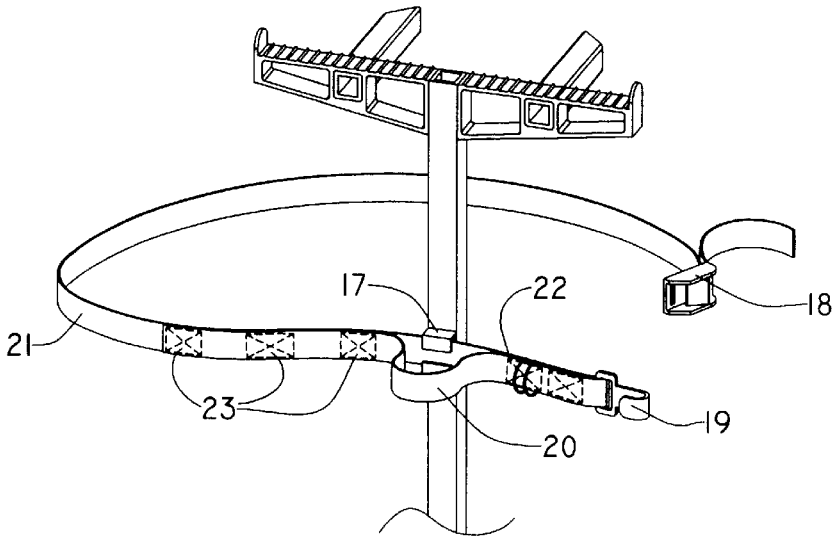
FIG. 6A is a view of a simplified strap with safety loop.
Figure 7A:
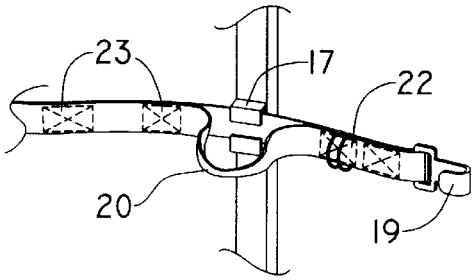
FIGS. 7A–7E are various embodiments of the safety loop feature of the flexible strap.

An important safety feature is present in the form of a loop 20 connected to strap 7 to which a climber 81 can attach a clip or buckle 86 connected to a tether or harness 85 worn by the climber. Details of the loop 20 are shown more clearly in FIGS. 6A and 7A. The main section 21 of strap 7 is placed into the clip 17 on support member 2 and threaded through the base of clasp 19. The strap 7 is then sewn to itself at stitching point 22. A loose loop 20 is then formed prior to again attaching the strap 7 to itself at stitching point 23. Preferably, the webbing of the loop 20 is folded lengthwise into a tubular shape and stitched to itself to create a reduced, semi-rigid, tubular-shaped portion of the loop 20. This strengthened portion of the loop 20 will better resist wear and provide a more defined region of the loop 20 for placement of the safety clip 86. If desired, a protective flexible tube or sleeve (not shown) may also be used over loop 20 to provide enhanced wear resistance. Because stitching point 23 is what establishes the loop 20, it must be exceedingly strong so as not to tear away under the stress of a fall. Therefore, it is preferable that several reinforced stitchings be made in this area to strengthen the attachment. As shown in FIGS. 1 and 6B–6D, a pair of D-rings 24 can be sewn between the portions of strap 7 at stitching point 22 so that greater strength can be imparted to the strap 7 during use. For example, the loose end 25 of strap 7 can be threaded through both D-rings 24 across buckle 18 and then passed back through the right-most D-ring and tightened. Should the connection between the buckle 18 and the clasp 19 fail, the foregoing procedure will ensure that the ladder module 1 will remain suspended from the tree.

Figure 7B:
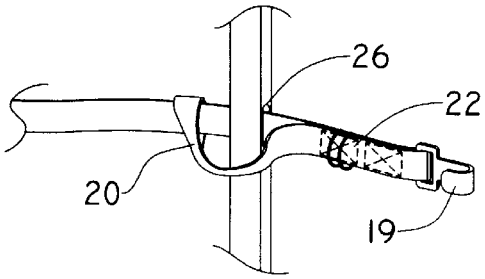
Figure 7C:
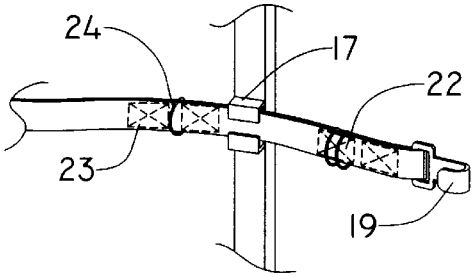
Figure 7D:
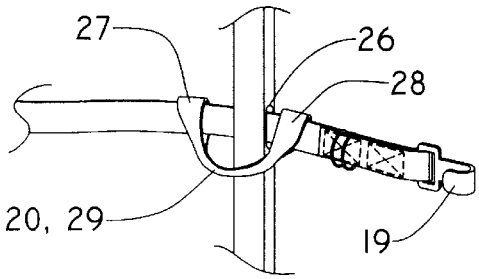
Figure 7E:
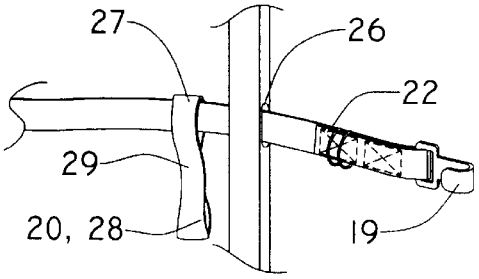

There are several alternative embodiments of the safety feature shown in FIGS. 7B–7E. FIG. 7B shows a similar arrangement, but wherein the left side of the loop 20 is allowed to slide along the strap 7. This embodiment of the strap 7 is also shown attached to the support member 2 by threading the strap 7 through a slot 26 formed through the support member 2. FIG. 7C depicts a very simplistic, but yet quite effective, safety loop 20 in the form of a single D-ring 24 attached between the portions of strap 7 at stitching point 23. FIG. 7D shows a loop 20 formed by threading the strap 7 through the looped ends 27,28 of a separate secondary strap section 29. Finally, FIG. 7E illustrates a safety loop 20 formed by allowing one of the looped ends 28 of the secondary strap section 29 to remain unattached and hanging from the strap 7. Optionally, the loop 20 can be constructed of an elastic or bunge-type material capable of absorbing energy in the event of a fall, thus reducing the stresses applied to the strap 7.

Although there are several ways to implement the safety loop 20 into the ladder module 1, each of the foregoing embodiments have an important common advantage: none of the safety loops 20 are attached directly to the support member 2. In attaching the safety loop 20 to the strap 7, the support member 2 bears very little of the impact stresses that would result from a fall. If the climber falls, the safety loop 20 pulls only against the strap 7, which is already in tension. Also, the location of the loop 20 immediately adjacent to the support member 2 provides a centralized pivot point after a fall which tends to align the climber back with the axis of the ladder module 1, thus enabling the climber to recover from the fall. Because of the construction of most straps 7 used for these purposes, the strap 7 is much more capable of withstanding the stress of a fall as opposed to the support member 2. For example, strap 7 is preferably constructed of nylon material having a tensile strength in excess of 2500 pounds. While the support member 2 is intended to be strong, a sudden and heavy force across the support member 2 may cause dangerous buckling or even breakage. While many of the safety aspects of the current invention could be achieved by attaching a loop directly to the support member 2, the strength of the support member 2 would have to be increased, which would almost certainly add more weight to the ladder module 1. Because one of the primary goals of the invention is to maintain the ladder module 1 as lightweight as possible, attachment of a loop 20 to the support member 2 would be less preferable than attaching it to the strap 7.

Another advantage of the safety loop 20 feature of the present invention is that unintentional wear and damage on the strap 7 is avoided, because the climber has precise control over the location of the connection. Under typical outdoor conditions, the strap 7 is exposed to the elements and subject to cyclic loads from climbing the ladder modules, both of which adversely affect the integrity of the strap material over time. Each of the embodiments in FIGS. 7A–7E allow the climber to connect the safety clip 86 to the loop 20, rather than directly to the strap 7. Thus, the repeated motions of clipping and unclipping during a climb avoids contact between the clip 86 and the material of the strap 7 which is in tension. The embodiments shown in FIGS. 7A, 7B, and 7D carry the additional benefits of distributing a falling load over two points along the strap 7, thereby minimizing any damage to the strap 7 as a result of a fall.

Figure 2:
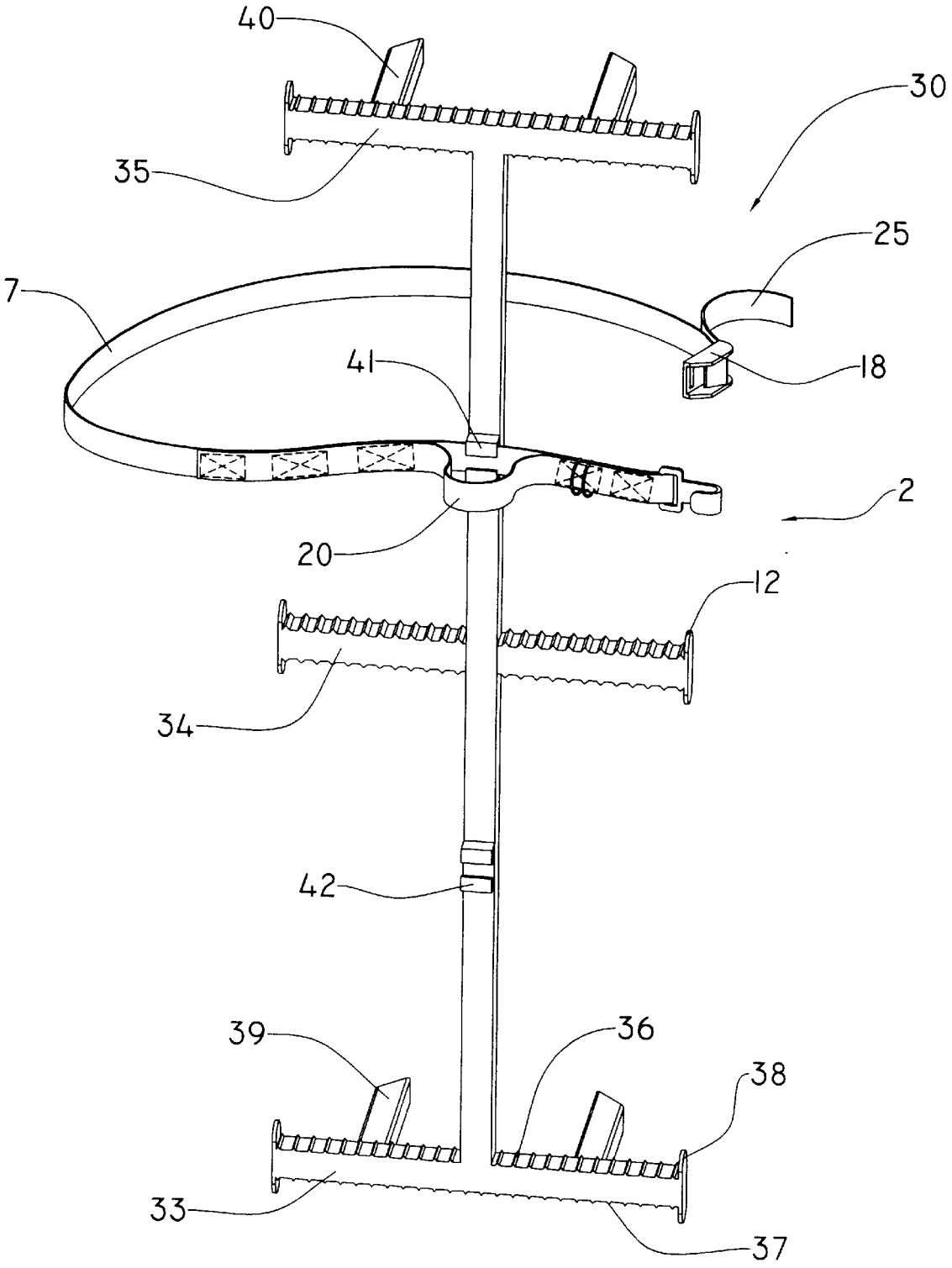
FIG. 2 is a perspective view of a bidirectional embodiment of the invention which can be oriented and climbed in either direction.
Figure 3:
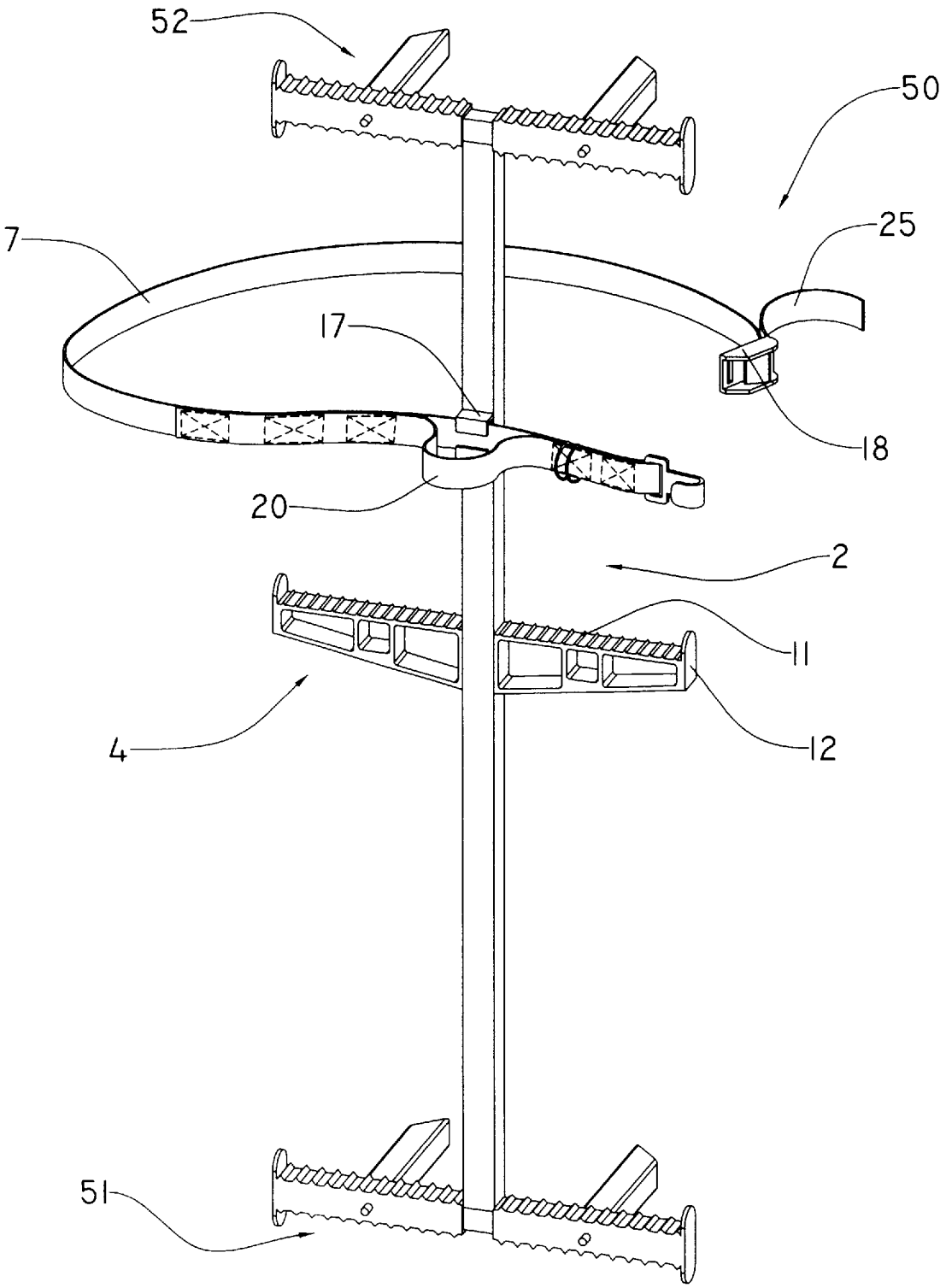
FIG. 3 is a perspective view of an alternate embodiment of the invention which includes pivotable top and bottom steps for storage of the ladder modules.
Figure 4:
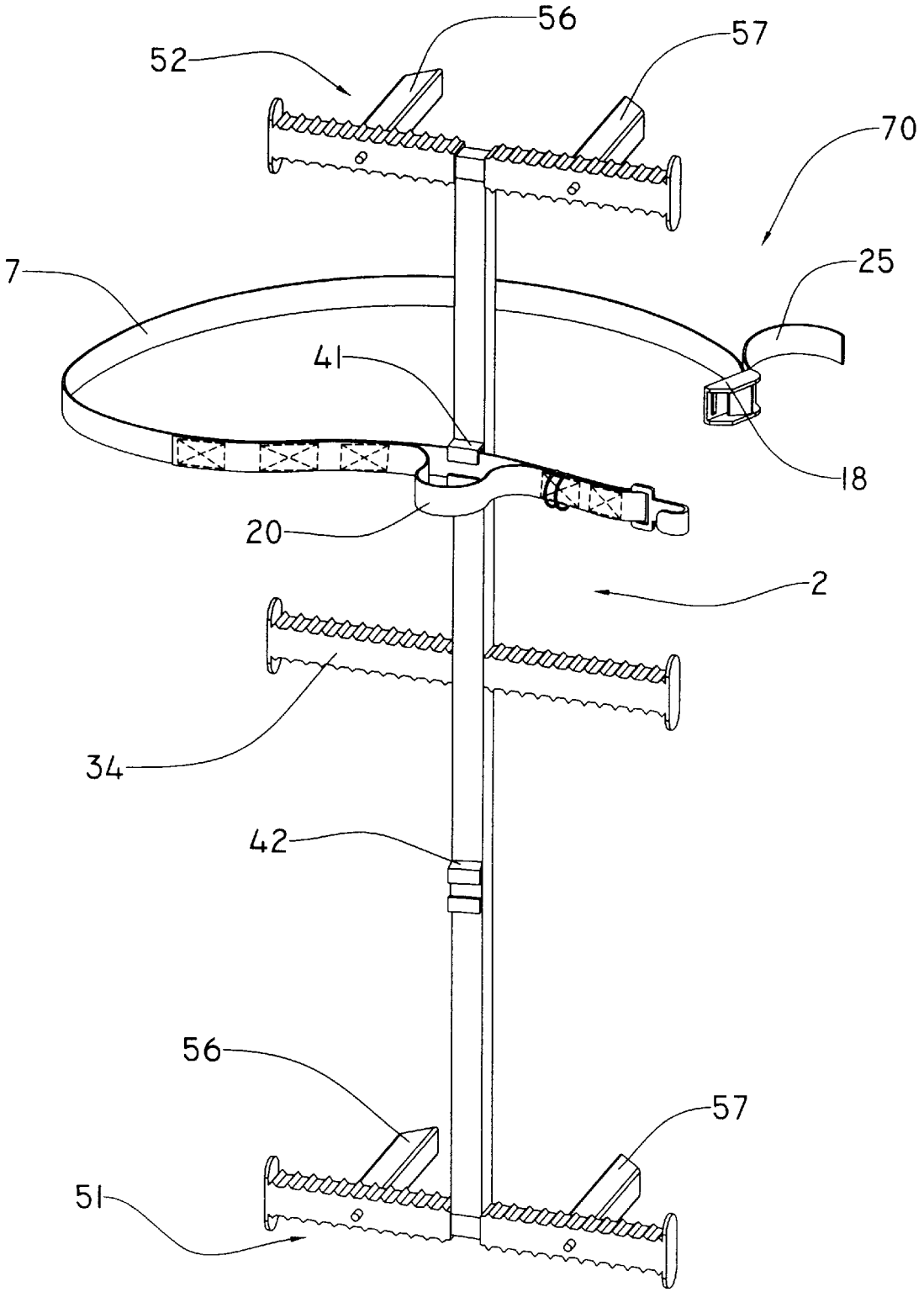
FIG. 4 is a perspective view of another bidirectional embodiment of the invention which also includes the pivotable steps.

Several alternative embodiments of the ladder module 1 are shown in FIGS. 2–4. In the embodiment 30 of FIG. 2, the extruded steps 3,4,5 are replaced by bottom, middle and top steps 33,34,35 which each include both an upper slip-resistant surface 36 and a lower slip-resistant surface 37. In addition, each step includes a retaining tab 38 which extends above and below each step. Two pairs of stand-off members 39,40 similar in structure and function to their counterparts in FIG. 1 are permanently attached to the bottom and top steps 33,35. Finally, the single strap clip 17 of FIG. 1 is replaced by two clips 41,42, each positioned toward the ends of the ladder module 1. The foregoing modifications allow this embodiment 30 to be used in either an upright orientation or an upside down orientation, because the same functionality is provided in either case. The only requirement is that the climber connect the strap 7 to the appropriate clip 41 or 42 so that the support member 2 is suspended from the higher clip.

Figure 5A:
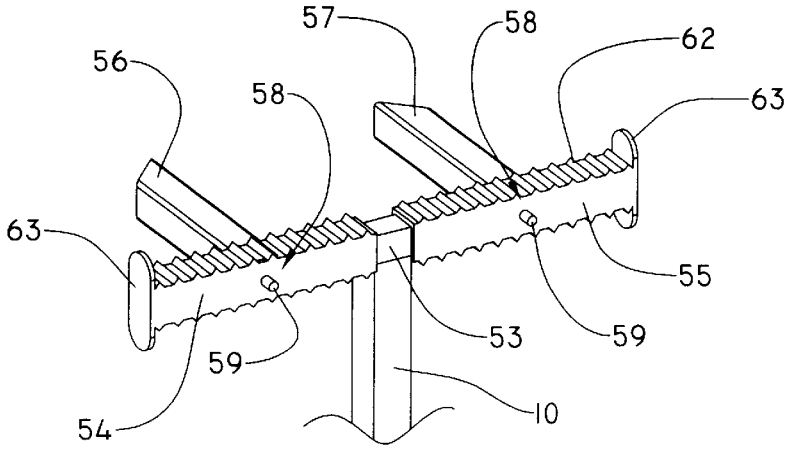
FIGS. 5A and 5B are detailed views of the pivotable steps.
Figure 5B:
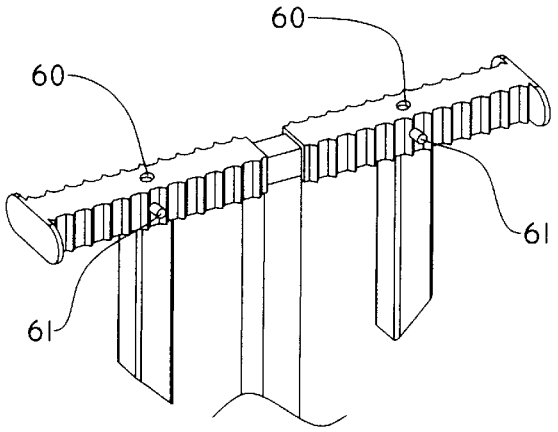

FIG. 3 depicts an embodiment 50 which employs the extruded middle steps 4 of FIG. 1, but which replaces the bottom and top steps 3,5 with two pairs of pivotable steps 51,52, shown in greater detail in FIGS. 5A and 5B. As the features of the top pivotable steps 51 are identical to those of the bottom pivotable steps 52, a description of the top steps 51 will suffice. Top steps 51 are comprised of a hollow square tube 53 which is wide enough for two boots of a climber and permanently attached to the upper end 10 of support member 2. The tube 53 extends in cantilever fashion from both sides of support member 2. A pair of identical step assemblies 54,55 are removably and slidably mounted on tube 53 and include stand-off members 56,57, respectively, as shown. Step assemblies 54,55 have square internal cross-sections which closely match the external cross-section of tube 53, and the outer surfaces of step assemblies 54,55 are square, or polygonal, in shape. The movement of step assemblies 54,55 is restrained by step locking means 58 disposed between each of step assemblies 54,55 and tube 53. Step locking means 58 may simply comprise a spring-loaded pin 59 affixed within tube 53 which lockingly mates with corresponding holes 60,61 on each of step assemblies 54,55.

For safety reasons, the location of pins 59 should be such that a climber will not inadvertently depress a pin 59 during a climb. In a preferred version, step assemblies 54,55 are thus adjustable between an operating position (in which stand-off members 56,57 are directed toward a tree) and a collapsed position (in which stand-off members 56,57 are essentially parallel with support member 2). Slip-resistant surfaces 62, as well as retaining tabs 63, are also present on step assemblies 54,55 as shown in FIGS. 5A and 5B. Likewise, step assemblies 54,55 can be slightly inclined as described for steps 3,4,5 of FIG. 1. It can be seen that the adjustable step assemblies 54,55 just described allow the hunter to stack and transport several ladder modules in a more compact manner.

A further alternative embodiment 70 is shown in FIG. 4, which is similar in most respects to the bidirectional ladder module 30 of FIG. 2. However, the pivotable steps 51,52 of FIGS. 5A and 5B are substituted for bottom and top steps 33,35. Thus, the advantages of bidirectionality and the ability to pivot the steps 51,52 are combined to maximize the ease of use and portability of the ladder modules.

Figure 8:
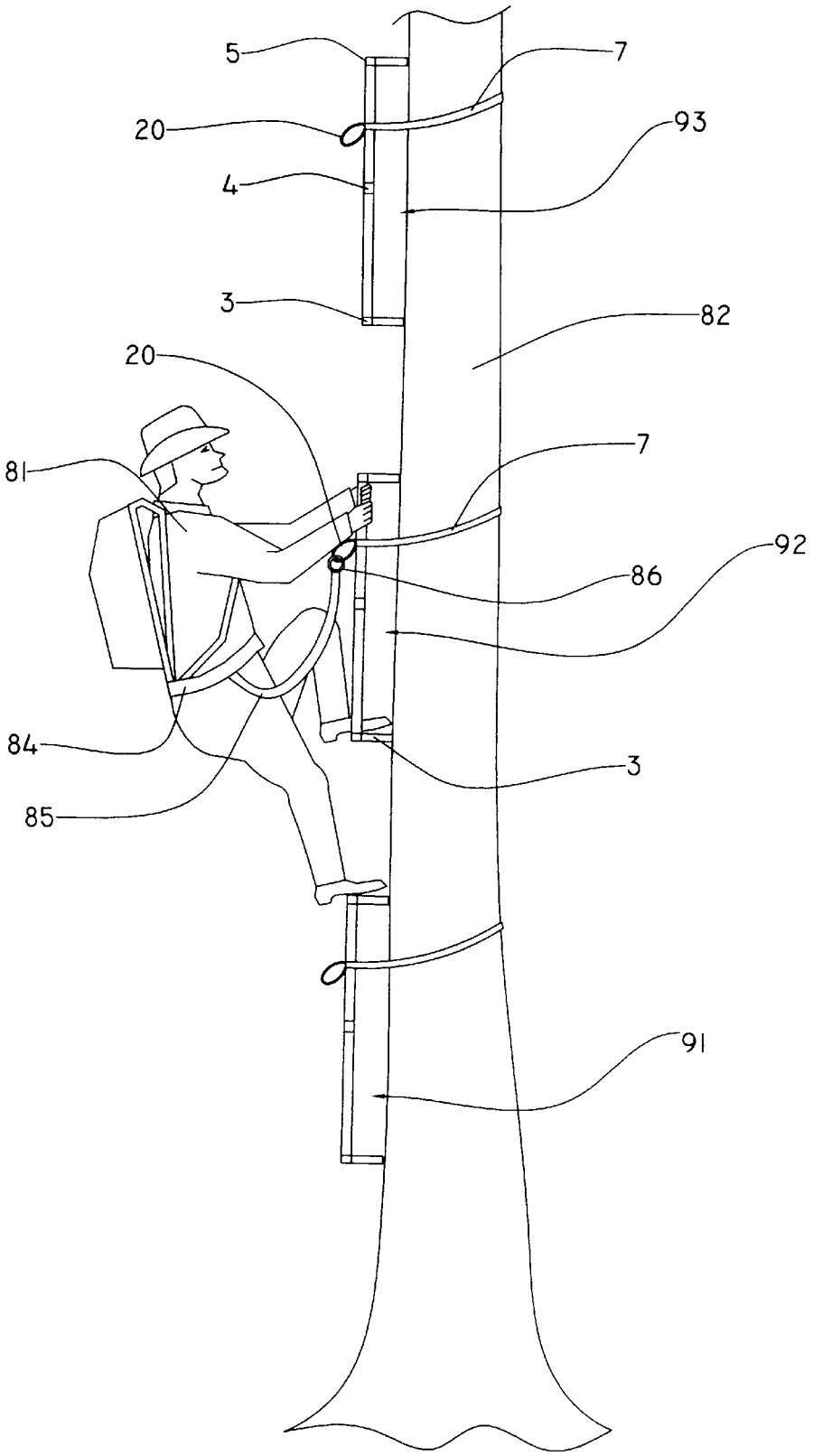
FIG. 8 is a view of a person climbing a tree with several of the ladder modules of the present invention, and which shows the climber connected to one of the ladder modules.
Figure 9:
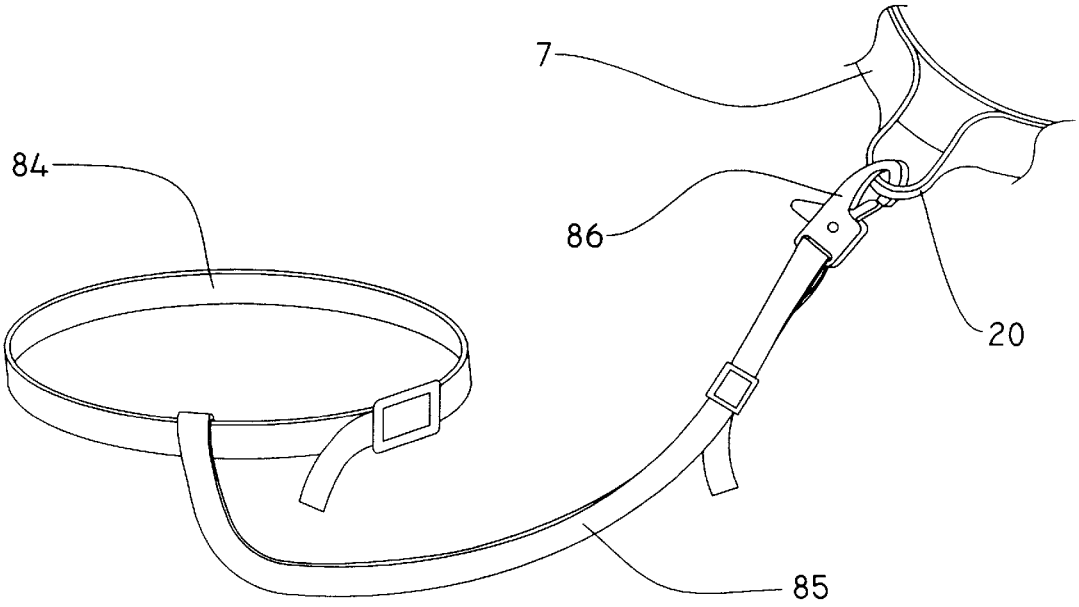
FIG. 9 is a more detailed view of the clip connected to the safety loop of the invention.

FIG. 8 is a side view of a climber 81 traversing the tree 82 using three ladder modules 91,92,93 of the present invention. The climber 81 is shown stepping from ladder module 91 to ladder module 92 while he is connected to the loop 20 by the adjustable safety tether 85 and safety belt 84. The adjustable tether 85 is preferably about three to four feet in length and terminates in a removable clip 86 or other type of fastener that can be quickly connected and disconnected from the safety loop 20. A more detailed view of the belt 84, tether 85, and clip 86 connected to loop 20 is shown in FIG. 9. As shown in FIG. 8, the climber 81 places both feet onto the bottom step 3 of the next ladder module 92, thus placing the strap 7 in tension and causing the ladder module 92 to become stable against the tree 82. The climber 81 then disconnects the clip 86 from the safety loop 20 and immediately connects it to the safety loop 20 on the next higher ladder module 93. Thus, if the climber 81 falls, the tether 85 minimizes the distance fallen by the climber 81 and keeps him in reach of the ladder module 92 or 93 to which he is safely connected.

Figure 10A:
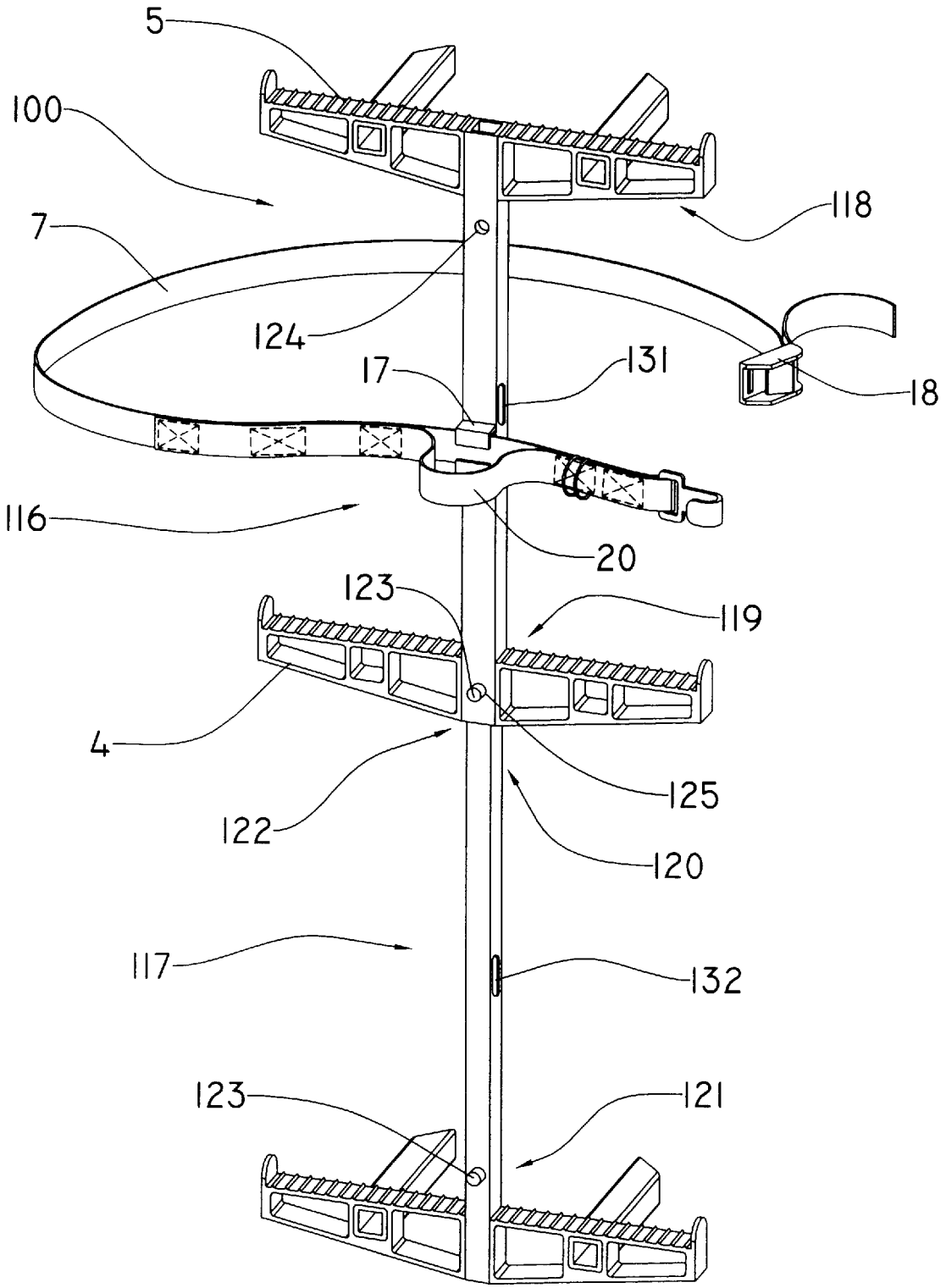
FIGS. 10A and 10B are perspective views of a further alternative embodiment of the invention which is adjustable between a retracted position and an extended position.
Figure 10B:
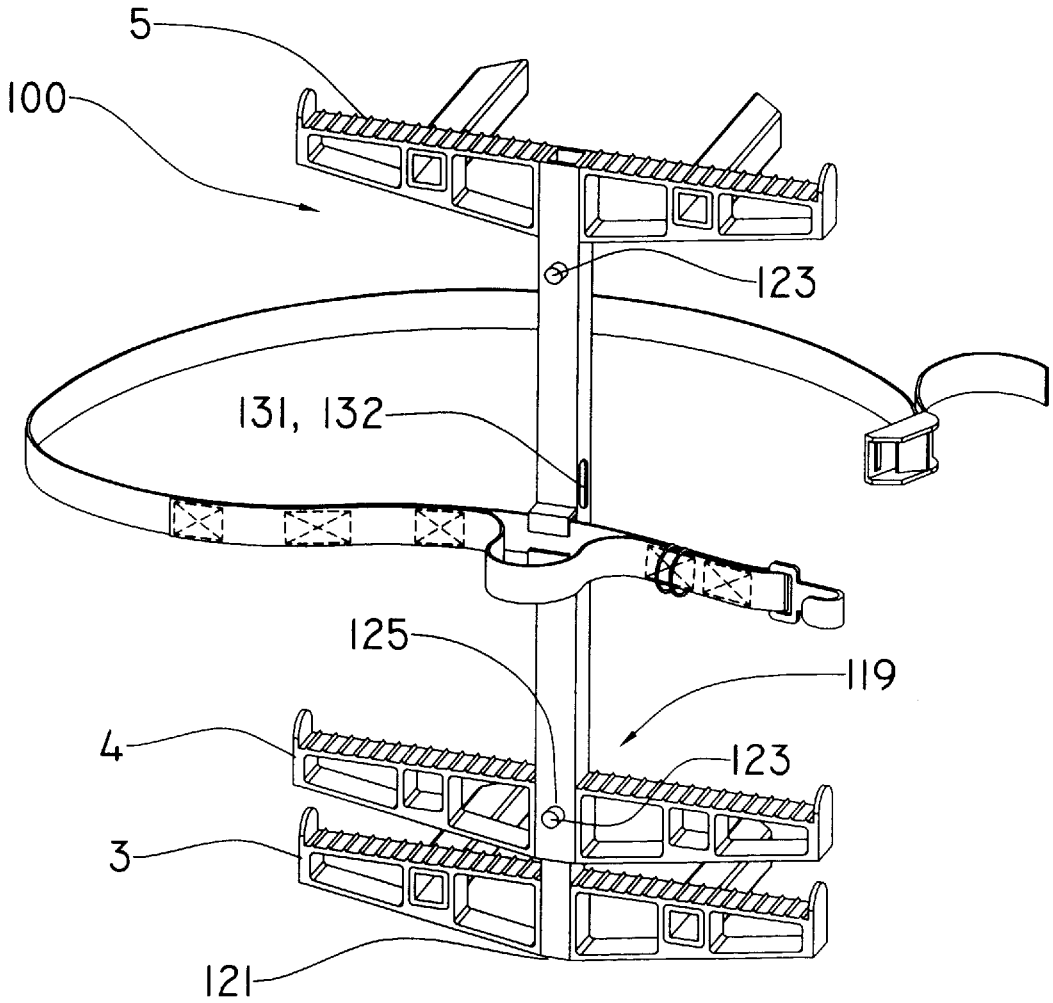

Turning now to FIGS. 10A and 10B, another alternate embodiment of the invention is depicted as an adjustable ladder module 100 whose length can be changed to suit the needs of the climber. This embodiment is similar in most respects to FIG. 1, and corresponding features are identical in structure and function unless otherwise stated. Ladder module 100 is shown in an extended position in FIG. 10A and generally comprises a hollow, primary support member 116 into which a secondary support member 117 is telescopingly slidable. Primary support member 116 includes an upper end 118 and a lower end 119, as well as a clip 17, flexible strap 7 with safety loop 20, and buckle 18 as described earlier herein. It should be understood that any of the safety straps 7 shown in FIGS. 7A–7E can be used with ladder module 100 to the same extent and with the same effectiveness as with any of the foregoing embodiments. Primary support member 116 further includes top steps 5 at upper end 118 and second steps 4 at lower end 119 similar to FIG. 1. Although greater or lesser lengths are possible, primary support member 116 should have a length of approximately 20 inches.

Secondary support member 117 also includes an upper end 120 and a lower end 121 and is approximately 20 inches in length. However, it must have a cross-section which will slide into and out of primary support member 116. Preferably, there should be a relatively tight fit between primary and secondary support members 116,117 so that when the ladder module 100 is in an extended position, there will be little movement between primary and secondary support members 116,117. First steps 3 are attached to lower end 121 of secondary support member 117 in the same manner as in the embodiment of FIG. 1.

In a retracted position as shown in FIG. 10B, secondary support member 117 is held almost entirely within primary support member 116 by locking means 122. Locking means 122 can be any device which effectively prevents secondary support member 117 from sliding relative to primary support member 116, such as a nut and bolt combination, or a spring-loaded pin 123. If spring-loaded pin 123 is employed, primary support member 116 will include first lock hole 124 at its upper end 118, and a second lock hole 125 at its lower end 119. Spring-loaded pins 123 are located on secondary support member 117 at a distance apart to match with first and second lock holes 124,125 in a retracted position. In the extended position shown in FIG. 10A, spring-loaded pin 123 at the upper end 120 of secondary support member 117 will engage second lock hole 125 of primary support member 116. The relative locations of second lock hole 125 and spring loaded pin 123 on the upper end 120 of secondary support member 117 should be such that at least three inches (3") of secondary support member 117 should remain within primary support member 116.

As an alternative to attaching the flexible strap 7 to clip 17, slots may be used which are similar to slot 26 shown in FIGS. 7B, 7D and 7E. As shown in FIGS. 10A and 10B, upper slot 131 is formed completely through primary support member 116 and is located at approximately the midpoint of the length of primary support member 116. Thus, the flexible strap 7 may be passed through upper slot 131 to secure the ladder module 100 in an extended position to a tree 82. Additionally, lower slot 132 is formed completely through secondary support member 117 and is located at approximately the midpoint of the length of secondary support member 117. Importantly, the precise locations of upper slot 131 and lower slot 132 along their respective support members 116,117 are such that lower slot 132 becomes aligned with upper slot 131 when secondary support member 117 is retracted and locked into primary support member 116. Therefore, the ladder module 100 is easily securable to tree 82 by passing flexible strap 7 through aligned slots 131,132 in a retracted position.

Figure 11A:
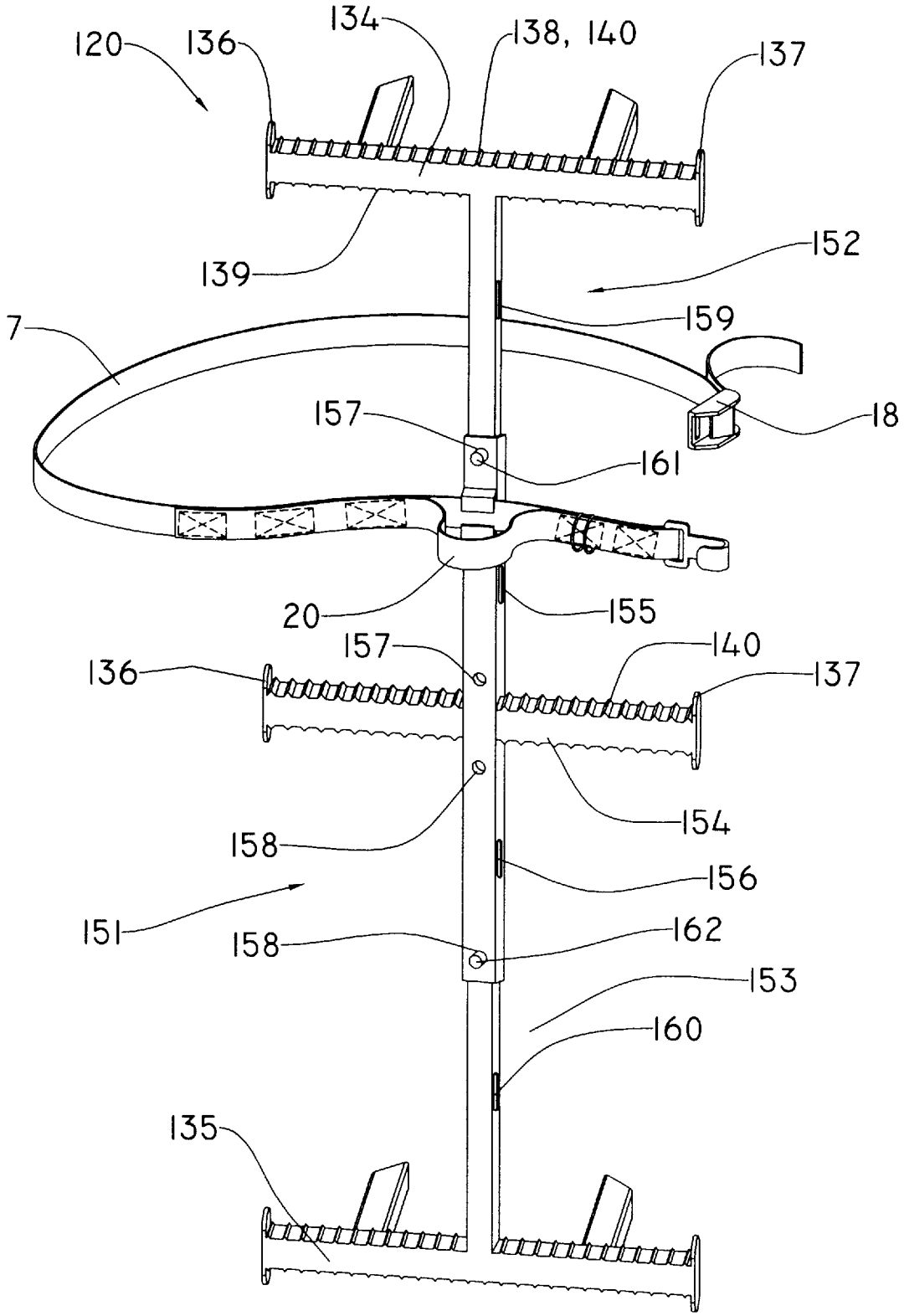
FIGS. 11A and 11B are perspective views of still another alternative embodiment of the invention wherein the primary and secondary support members are independently extendable and retractable relative to a central support member.
Figure 11B:
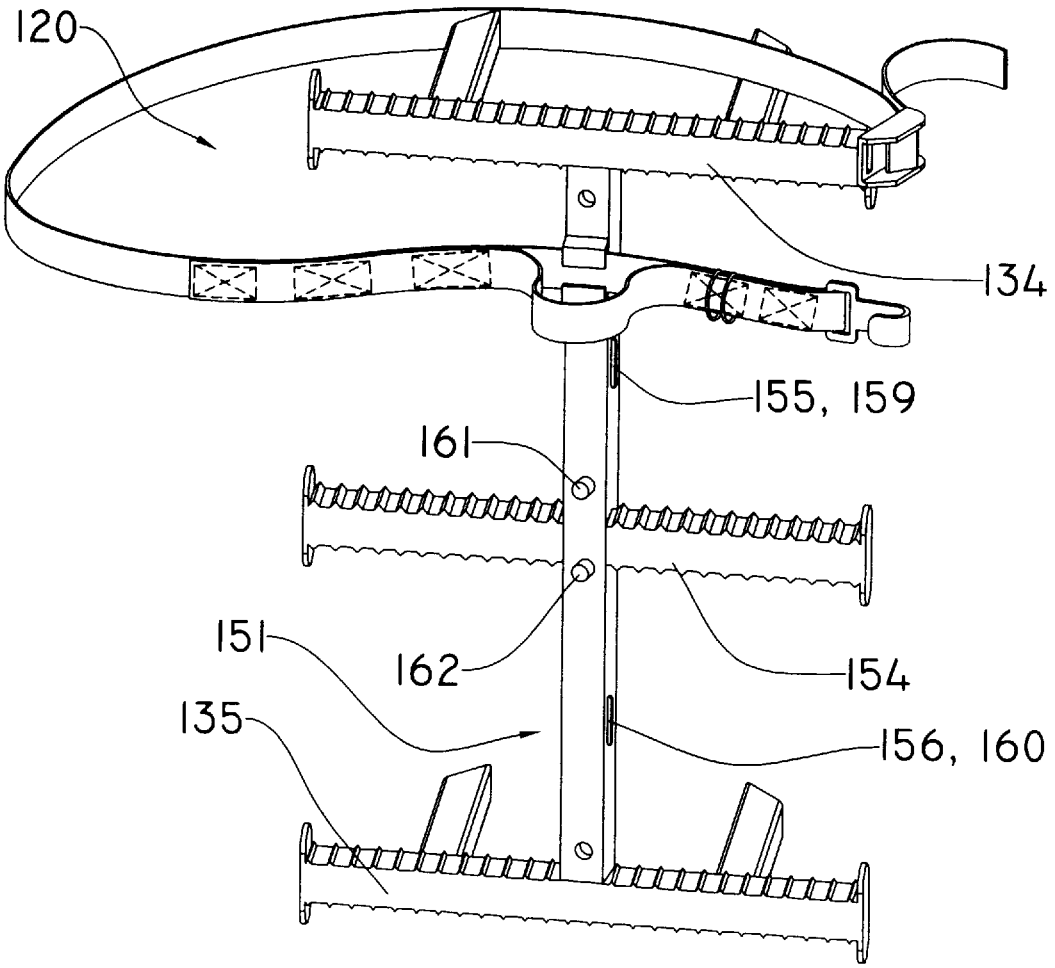

A further alternative embodiment depicts ladder module 120 in FIGS. 11A and 11B which includes two separately adjustable portions. Central support member 151 is constructed of lightweight, aluminum tubing having a hollow cross-section sized to slidably mate with upper support member 152 and lower support member 153. It will be appreciated that the designations of support members 152, 153 as "upper" and "lower" are made solely for the purposes of this description, as this ladder module 120 may be used in either an upright or inverted orientation. The bidirectional nature of ladder module 120, therefore, provides much greater versatility than its predecessors. Top step 134 is wide enough to accommodate both shoes of a climber and is perpendicularly attached at its midpoint to the distal end of upper support member 152, as shown in FIG. 11A. Retaining tabs 136,137 are affixed to both ends of top step 134 and extend beyond the upper and lower surfaces 138,139. Likewise, the upper and lower surfaces 138,139 of top step 134 include a non-slip or abrasive surface 140 so that a climber can have sure footing on ladder module 120 in an upright or inverted orientation. Bottom step 135 includes identical features, but is perpendicularly attached at its midpoint to the distal end of lower support member 153. Middle step 154 extends perpendicularly from both sides of the approximate midpoint of central support member 151 and includes retaining tabs 136,137 on each end, as well as upper and lower non-slip surfaces 140.

It should be understood that the steps 3,4,5 of ladder module 100 in FIG. 10A can be replaced with top step 134, middle step 154 and bottom step 135 so that ladder module 100 can likewise be used in a bidirectional manner. If so, flexible strap 7 would then be passed through lower slot 132 when secondary support member 117 is in an extended position.

Thus, in FIGS. 11A and 11B, upper and lower support members 152,153 are identical in structure and function, except that upper support member 152 is placed within one end of central support member 151, while lower support member 153 is placed within the opposite end of central support member 151 as shown in FIG. 11A. Central slots 155,156 are formed completely through central support member 151, and are located above and below middle step 154, respectively. Preferably, central slot 155 is formed roughly halfway between middle step 154 and the upper end of central support member 151, whereas central slot 156 is formed symmetrically opposite central slot 155. Locking means 122 is also present in this ladder module 120 through the use of upper lock holes 157 and lower lock holes 158 formed into central support member 151. Upper lock holes 157 are located along central support member 151 to correspond to retracted and extended positions of upper support member 152. Likewise, lower lock holes 158 are located along central support member 151 to correspond to retracted and extended positions of lower support member 153. Spring-loaded pins 161,162 are located on upper and lower support members 152,153, respectively, to mate with the appropriate lock holes 157,158 in either a retracted or extended position.

Referring specifically to upper support member 152, upper slot 159 is formed through approximately the midpoint of the length of upper support member 152. Thus, flexible strap 7 may be passed through upper slot 159 to secure the ladder module 120 in an extended position to a tree 82. Similar to ladder module 100, the precise locations of upper slot 159 and central slot 155 along their respective support members 152,151 are such that upper slot 159 becomes aligned with central slot 155 when upper support member 152 is retracted and locked into central support member 151. Therefore, the ladder module 120 is easily securable to a tree 82 by passing flexible strap 7 through aligned slots 155,159 when upper support member 152 is in a retracted position. As stated earlier, lower support member 153 is identical in construction to upper support member 152. Therefore, the locking of lower support member 153 in either a retracted or extended position, as well as the possible placements of flexible strap 7 through either or both of slots 156,160, is perfectly symmetrical to upper support member 152.

From the foregoing description, it can be seen that flexible strap 7 may be passed through lower slot 160 if desired, so that ladder module 120 can be used with equal effectiveness when lower support member 153 is in an extended position, but in an "inverted" (as opposed to an "upright") orientation. Likewise, lower support member 153 can be retracted, and flexible strap 7 can be passed through both slots 156,160.

In the interest of keeping ladder module 120 as compact, yet versatile, as possible, it is preferable that its maximum length be kept below about 37 inches long when both upper and lower support members 152,153 are extended. Depending upon the relative lengths of central support member 151 and upper and lower support members 152,153, as well as the exact locations of pins 161,162 and lock holes 157,158, the overall length of ladder module 120 will be approximately 21 inches long when both upper and lower support members 152,153 are retracted. Due to its symmetry, it can be seen that ladder module 120 may easily be used in either an inverted or upright orientation, and that the ability to extend or retract either end offers a degree of versatility and maneuverability to climbers heretofore unknown in this industry.

Figure 12A:
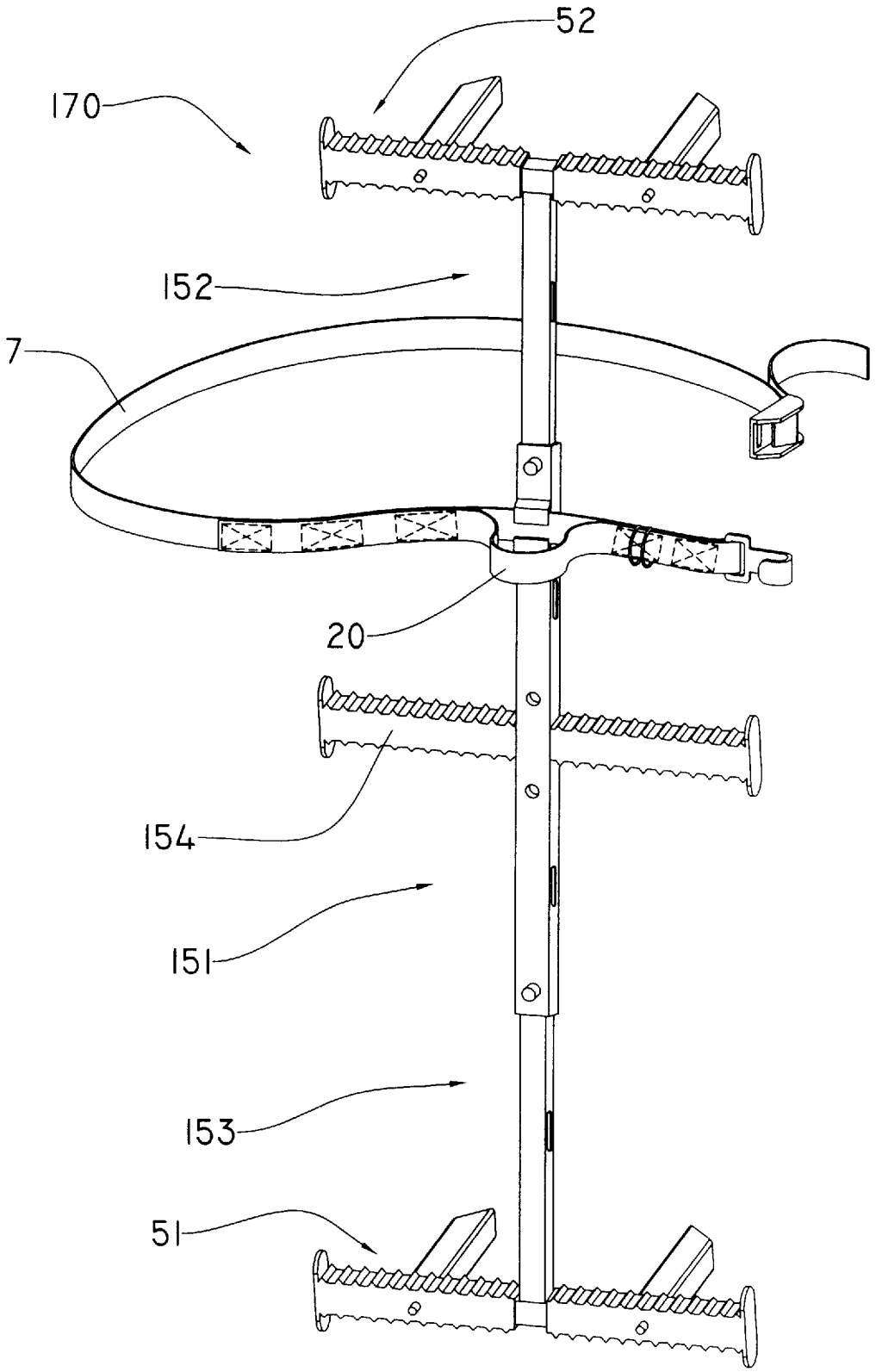
FIGS. 12A and 12B are perspective views of the embodiment of FIGS. 11A and 11B, but which include the pivotable steps of FIGS. 5A and 5B.
Figure 12B:
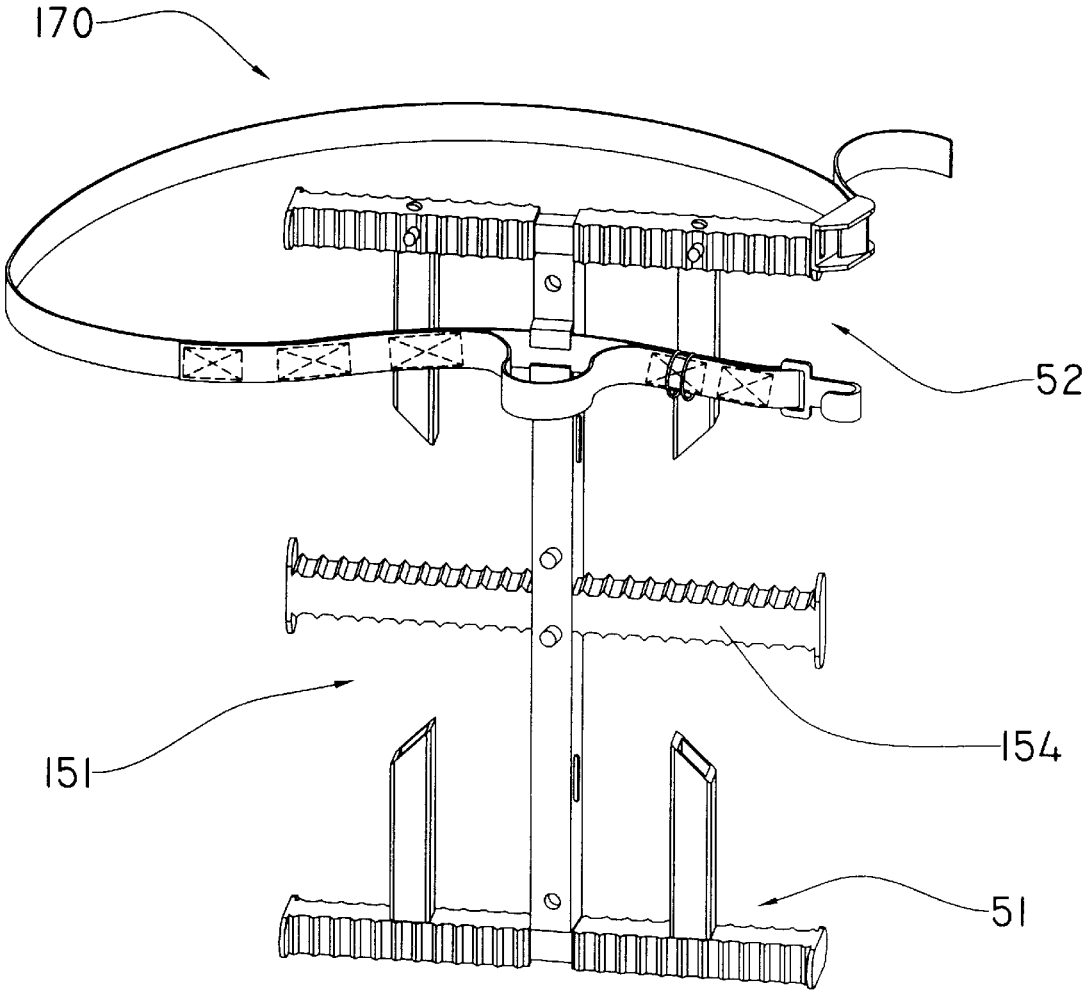

FIGS. 12A and 12B show a ladder module 170 which is similar to ladder module 120, but which incorporates the pivotable steps 51,52 of FIGS. 5A and 5B as a replacement for bottom step 135 and top step 134. FIG. 12B clearly depicts the manner in which pivotable steps 51,52 reduce the volume of ladder module 170 for transportation and storage purposes. Thus, the advantages of bidirectionality and the ability to pivot the steps 51,52 are combined to maximize the portability and ease of use of ladder module 170.

Figure 13:
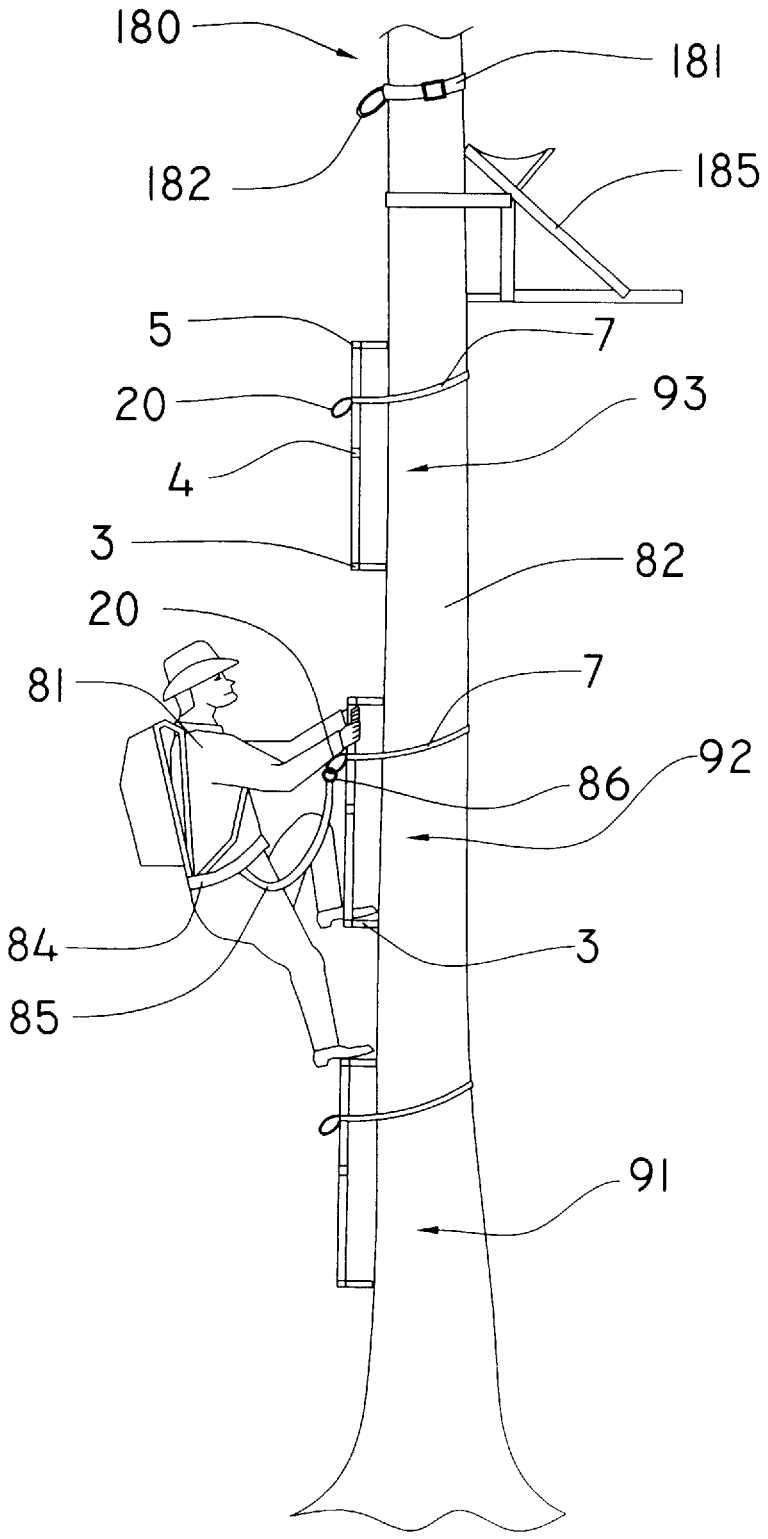
FIG. 13 depicts a climbing scenario similar to FIG. 8, but with the addition of a fixed loop on the tree as an aid to safely maneuvering into a tree stand.

Finally, FIG. 13 depicts a climbing scenario similar to FIG. 8 wherein any of the foregoing embodiment may be used, but with the addition of supplemental safety means 180 fixed to the tree 82. Supplemental safety means may include a belt 181 having a loop 182 similar to the safety loop 20 of flexible strap 7. As the climber 81 ascends the last ladder module 93 and places both shoes on the bottom step 3, the clip 86 would be disconnected from the safety loop 20 and immediately re-attached to loop 182. Thus, the climber 81 could step directly from the top step 5 to the tree stand platform 185 while secured to loop 182. Importantly, the use of supplemental safety means 180 ensures that the climber 81 is safely tethered at every point in the climb from the ground to the tree stand 185. For maximum safety, the climber 81 should remain connected to the loop 182 the entire time he is in the tree stand.

The overall concept of the foregoing embodiments of the invention is directed to providing a ladder system having a low-profile and adjustable design for ease of carrying and storage which integrates previously unavailable safety features to prevent injuries from falling. This design also helps the hunter in achieving a totally camouflaged appearance, because it is smaller and less bulky than competing designs. Furthermore, the thin structural components enable the ladder modules to be placed within very tight spaces among tree limbs, contrary to double-rail designs seen in the art.

Although the present invention has been described in terms of specific embodiments, it is anticipated that alterations and modifications thereof will no doubt become apparent to those skilled in the art. It is therefore intended that the following claims be interpreted as covering all such alterations and modifications as fall within the true spirit and scope of the invention.

I claim:

1. A portable ladder module for climbing a tree, comprising:

(a) a single primary support member having first step, wherein said first step is permanently attached to said primary support member;

(b) a single secondary support member having a second step, wherein said second step is permanently attached to said secondary support member and wherein said secondary support member is slidable relative to said primary support member;

(c) locking means operatively disposed between said primary support member and said secondary support member for selectively locking the position of said secondary support member relative to said primary support member;

(d) single flexible means removably attached to said primary support member for suspending said ladder module from said tree, wherein said flexible means is placed in tension when weight is exerted on said ladder module, and wherein said primary support member further includes connection means for securely connecting said flexible means to said primary support member;

(e) first and second stabilizing means attached to said primary support member and said secondary support member, respectively, for stabilizing said ladder module against said tree and separating said primary support member and said secondary support member from said tree by a predetermined distance, wherein said first and second stabilizing means includes edges which are caused to forcibly contact said tree and prevent movement of said ladder module against said tree when said flexible means is placed in said tension; and (f) safety attachment means connected to said flexible means for allowing a secure attachment between said flexible means and a coupling device on a climber, wherein said safety attachment means is horizontally centered on said primary support member and constructed in a manner to support the weight of said climber and wherein said safety attachment means comprises a strap having a first end and a second end, wherein said first end and said second end are both connected to said flexible means and said strap straddling said connection means.

2. The ladder module of claim 1, wherein said secondary support member is telescopingly slidable within said primary support member, and wherein said primary support member further includes a third step.

3. The ladder module of claim 1, wherein said primary support member is telescopingly slidable within said secondary support member, and wherein said secondary support member further includes a third step.

4. The ladder module of claim 1, further including a central support member slidably disposed between said primary support member and said secondary support member, and wherein said central support member includes a third step.

5. The ladder module of claim 1, wherein said first and second steps are wide enough to accommodate both shoes of a climber, and wherein each of said first and second steps includes a pair of retaining tabs extending upward and downward from each of the ends of said first and second steps.

6. The ladder module of claim 1, wherein said first and second steps each includes an upper and lower non-slip surface.

7. The ladder module of claim 2, wherein said third step includes a retaining tab extending upward and downward from the end of said third step.

8. The ladder module of claim 2, wherein said third step includes an upper and lower non-slip surface.

9. The ladder module of claim 3, wherein said third step includes a retaining tab extending upward and downward from the end of said third step.

10. The ladder module of claim 3, wherein said third step includes an upper and lower non-slip surface.

11. The ladder module of claim 1, wherein said primary support member includes a first slot, wherein said secondary support member includes a second slot, wherein said first slot and said second slot are alignable when said ladder module is retracted, and wherein said flexible member is adapted to pass through said first slot or said second slot.

12. The ladder module of claim 4, wherein said primary support member includes a first slot, wherein said central support member includes a second slot, wherein said first slot and said second slot are alignable when said primary support member is retracted, and wherein said flexible member is adapted to pass through said first slot or said second slot.

13. The ladder module of claim 1, wherein said first stabilizing means is attached to said first step, and said second stabilizing means is attached to said second step; wherein said first step is removably and lockingly slidable relative to said primary support member; and wherein said second step is removably and lockingly slidable relative to said secondary support member.

14. The ladder module of claim 1, wherein said strap is connected to said flexible means by a first loop and a second loop through which said flexible means is passed when said ladder module is attached to said tree.

15. The ladder module of claim 1, wherein said strap is connected to said flexible means by a first loop through which said flexible means is passed when said ladder module is attached to said tree, and a second end affixed to said flexible means.

16. The ladder module of claim 1, wherein said safety attachment means comprises a strap having a first end and a second end, wherein said first end and said second end are both affixed to said flexible means.

17. The ladder module of claim 1, wherein said flexible means is a strap having:

(a) a first end terminating in first coupling means for interconnection with second coupling means; and (b) a second end terminating in a second coupling means for interconnection with said first coupling means, wherein said second end further includes an extended portion of said strap; and wherein said first end further includes a third coupling means for securing said extended portion of said strap.

18. The ladder module of claim 1, wherein said first step and said second steps are positionable to allow said first and second stabilizing means to be aligned with said primary support member and said secondary support member, respectively, for carrying and storage.

* * * * *